US005322195A

United States Patent [19]

Ellis

[11] Patent Number: 5,322,195

[45] Date of Patent: Jun. 21, 1994

[54] APPARATUS FOR DISCHARGING PARTICULATE SOLIDS

[75] Inventor: Peter J. Ellis, Salford, Great Britain

[73] Assignee: Bagfilla Overseas Limited, Lutterworth, England

[21] Appl. No.: 772,287

[22] Filed: Oct. 7, 1991

[51] Int. Cl.[5] ..... B65D 35/56

[52] U.S. Cl. ..... 222/105; 222/181; 222/504; 251/7

[58] Field of Search ..... 222/105, 181, 183, 185, 222/527-530, 504, 507; 251/4, 7; 383/906, 66, 67, 68, 69, 71, 72

[56] References Cited

U.S. PATENT DOCUMENTS 2,681,751 6/1954 Stone et al. ..... 222/181 X
2,846,179 8/1958 Monckton ..... 222/507 X
2,963,258 12/1960 Stambera ..... 222/212 X
3,924,781 12/1975 Witte ..... 222/181 X
4,883,201 11/1989 Poulton ..... 222/105
4,966,311 10/1990 Taylor ..... 222/181 X

*Primary Examiner*—Kevin P. Shaver
*Attorney, Agent, or Firm*—Charles J. Brown

[57] ABSTRACT

Apparatus for discharging particulate solids from a flexible bag wherein a lower end of the bag and its spout are located within a hopper with the spout accessible through an opening in the hopper wall and wherein a constricting device is included for choking the bag spout to restrict flow therethrough so that the spout can be tied off and closed by access through the hopper wall opening.

10 Claims, 2 Drawing Sheets

APPARATUS FOR DISCHARGING PARTICULATE SOLIDS

This invention concerns materials handling equipment, and more particularly equipment for discharging particulate solid materials from intermediate bulk containers of the kind (hereinafter termed containers of the kind referred to) comprising a flexible bag—which may or may not have an inner lining—having a normally tied tubular spout through which discharge can be effected after the spout has been untied.

Containers of the kind referred to are normally discharged using a special discharge machine including means to support the bag over a generally hopper-like receptacle for the bottom of the bag and having a door giving access to the spout to permit untying thereof.

Hitherto, once the spout has been untied the user is effectively committed to discharge the entire content of the bag.

It is now recognised that for certain applications this may not be desirable.

It is therefore an object of the invention to provide a machine for discharge of a container of the kind referred to which enables the spout to be re-tied before the bag has been emptied completely and to thus permit removal of the partially emptied container from the machine.

According to the present invention there is provided a machine for discharge of a container of the kind referred to including a hopper to receive the lower end of the bag and its spout which is accessible by means of an opening in the hopper wall, characterised by constricting means actuable to choke the spout to restrict flow therethrough to enable tying of the spout by access through said opening.

The constricting means may comprise a pair of flexible loops embracing the spout from each of opposite sides thereof and movable outwardly away from one another to compress and close the spout therebetween.

The loops may be constrained to remain juxtaposed with one another by being threaded together.

The loops may be movable by pneumatic or hydraulic cylinder actuator means.

A cord may extend from each loop to means pulling same to open the loops when released from their spout closing position.

The pulling means may comprise a counterweight.

The constricting means need not operate only to arrest flow from the spout, but may be operable to reduce the effective cross-sectional area of the spout to control flow in the manner of a valve.

The invention will be further apparent from the following description with reference to the several figures of the accompanying drawings, which show, by way of example only, one form of machine embodying same.

Figure 1:
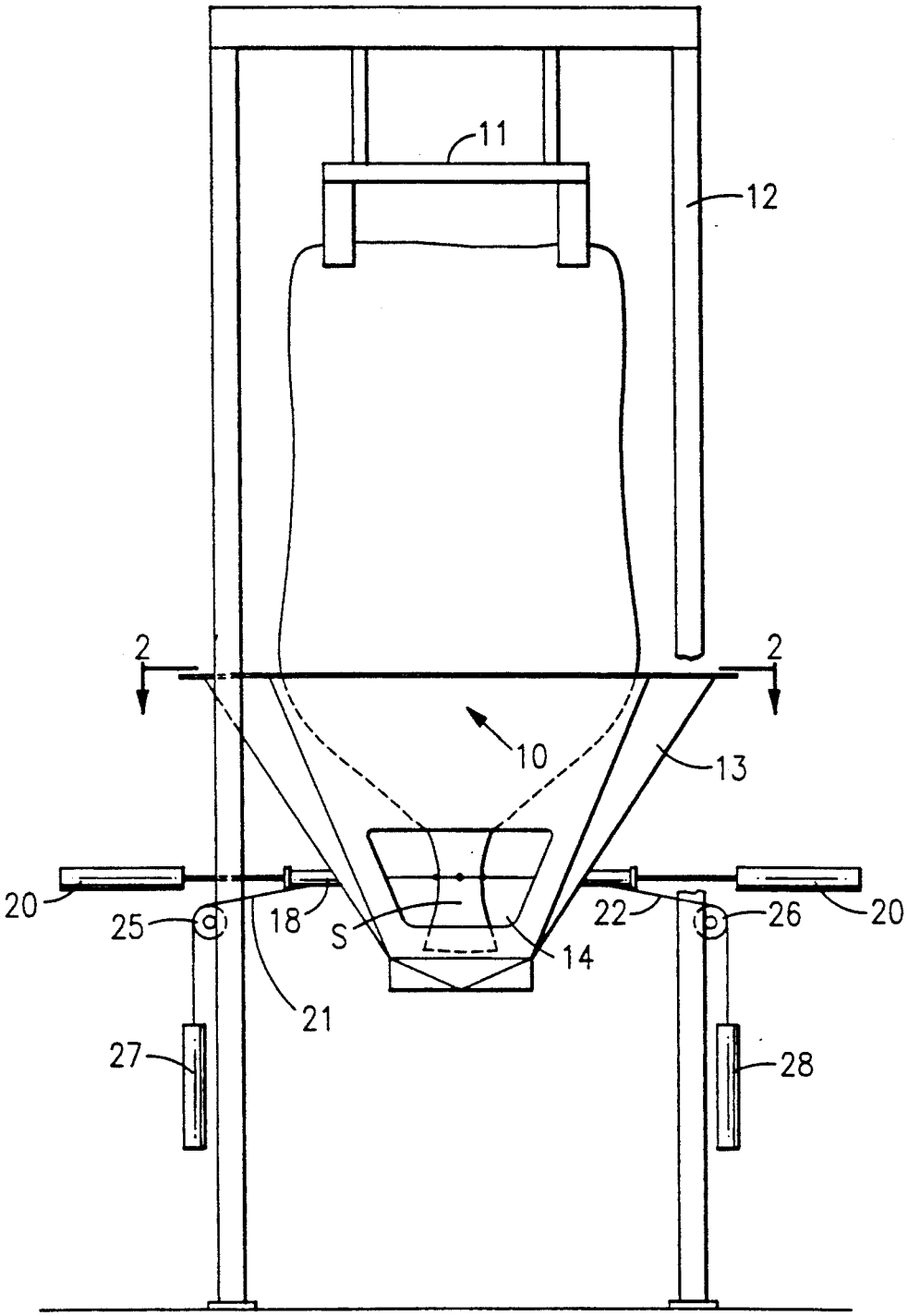
FIG. 1 shows a side elevation of the machine.
Figure 2:
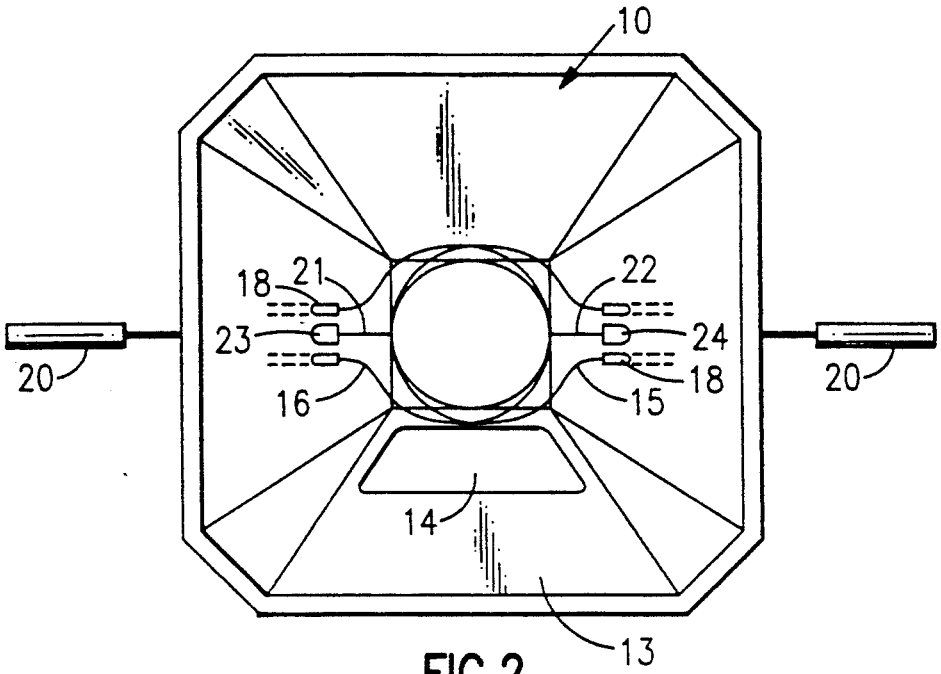
FIG. 2 shows a cross-section through the machine on the line II—II of FIG. 1.
Figure 3:
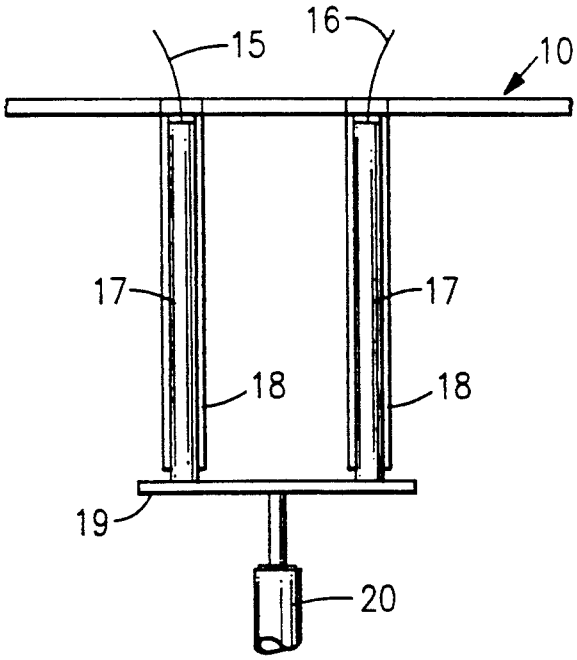
FIG. 3 shows a machine detail on an enlarged scale.

Referring now to the drawings, it will be seen that the machine comprises a hopper 10 for receiving the lower end of a container C and its discharge spout S (shown in dotted lines in FIG. 1) suspended over the hopper 10 from a rigging frame 11 supported by vertical posts 12 at the corners of the hopper 10.

One side wall 13 of the hopper 10 incorporates a door 14 through which the spout S may be accessed for the purposes of untying and re-tying same.

Above the level of the door, but within the confines of the hopper 10 is constricting means for the spout S comprised by a pair of loops 15 and 16 of wire rope embracing the spout S from opposite sides thereof. The opposite ends of each of the loops are connected with rods 17 slidable in flexible nylon tubes 18. The ends of the rods 17 on each side of the machine remote from the loops are joined by a yoke 19 connected with a double-acting pneumatic cylinder 20.

The loops 15 and 16 are constrained to lie generally in a common plane by being threaded together.

In use the container C is positioned on the machine and the spout passed unrestricted through the loops 15 and 16. The spout is untied by access through door 14 to enable discharge to be effected.

At any time before the container C has been emptied completely the yokes 19 may be moved apart by the cylinders 20 to cause the loops 15 and 16 to squeeze the spout S therebetween to choke the flow of material completely enabling the spout to be re-tied and the container removed, if desired, from the machine for storage.

Of course, the yokes 19 may also be moved to a desired limited extent to partially constrict flow through the spout and control same in the fashion of an adjustable valve.

When the cylinders 20 are operated to release the loops 15 and 16 from their spout closing position their return and opening is assisted by cords 21 and 22 extending from their closed ends through sleeves 23 and 24 in the wall of the hopper 10 to pass over pulleys 25 and 26 to counterweights 27 and 28. The action of the cords 21 and 22 also prevents the loops 15 and 16 from dropping downwardly in the hopper 10.

It will be appreciated that it is not intended to limit the invention to the above example only, many variations, such as might readily occur to one skilled in the art, being possible, without departing from the scope thereof.

I claim:

1. Apparatus for discharging particulate solids from a flexible bag suspended with a spout thereof within a hopper comprising a) an opening in a wall of the hopper permitting access to the bag spout, and b) a pair of flexible loops embracing the bag spout from each of opposite sides thereof and movable outwardly away from one another to constrict and close the spout therebetween to enable re-tying of the spout by access through said opening.

2. Apparatus according to claim 1 wherein the loops are constrained to remain juxtaposed with one another by being threaded together.

3. Apparatus according to claim 1 wherein the loops are movable by a pneumatic or hydraulic cylinder actuator.

4. Apparatus according to claim 1 wherein said loops are of wire rope.

5. Apparatus according to claim 1 where a cord extends from a closed end of each loop to pulling means for assisting in returning and opening the loops when released from their spout closing position.

6. Apparatus according to claim 5 wherein said cords extend over pulleys to counterweights.

7. Apparatus according to claim 5 wherein the cords pass through tubes extending through the hopper wall.

8. A machine according to claim 1 wherein free ends of each loop pass through tubes extending through the hopper wall.

9. Apparatus according to claim 7 wherein said tubes are of flexible plastic material.

10. Apparatus according to claim 8 wherein said tubes are of flexible plastic material.

* * * * *